US009354005B1

(12) United States Patent
Russo et al.

(10) Patent No.: US 9,354,005 B1
(45) Date of Patent: May 31, 2016

(54) REDUCED FRICTION FIREARM COMPONENTS

(71) Applicants: Carmelo Russo, Port Richey, FL (US); Jason Adams, Port Richey, FL (US)

(72) Inventors: Carmelo Russo, Port Richey, FL (US); Jason Adams, Port Richey, FL (US)

( * ) Notice: Subject to any disclaimer, the term of this patent is extended or adjusted under 35 U.S.C. 154(b) by 0 days.

(21) Appl. No.: 14/596,163

(22) Filed: Jan. 13, 2015

(51) Int. Cl.
*F41A 5/20* (2006.01)

(52) U.S. Cl.
CPC ..... *F41A 5/20* (2013.01)

(58) Field of Classification Search
CPC ..... F41A 29/00; F41A 3/44; F41A 3/46; F41A 5/20
USPC ..... 89/191.02, 1.1, 191.01, 1.25
See application file for complete search history.

(56) References Cited

U.S. PATENT DOCUMENTS 1,365,355 A * 1/1921 Thompson ..... F41A 3/16 42/16
3,636,648 A * 1/1972 Spencer ..... F41A 19/13 42/16
3,742,638 A * 7/1973 Archer ..... F41A 3/30 42/16
3,951,126 A * 4/1976 Rau ..... F41B 11/642 124/67
4,524,671 A * 6/1985 Bender ..... F16C 29/04 384/51
6,200,225 B1 * 3/2001 Hobaugh, II ..... F16C 3/035 384/49

* cited by examiner

*Primary Examiner* — Troy Chambers
*Assistant Examiner* — Bridget Cochran
(74) *Attorney, Agent, or Firm* — Gulf Coast Intellectual Property Group

(57) ABSTRACT

A reduced friction firearm component that is movably mounted within a firearm wherein that is configured to slidably engage an adjacent element with reduced friction. The reduced friction firearm component further includes a body that is cylindrical in shape. The body includes an exterior surface and further includes a first end and a second end. Formed within the exterior surface of the body are a plurality of grooves. The plurality of grooves extend inward along said body from said first end and said second end. Rotatably mounted within said plurality of grooves are a multitude of ball bearings. A fastener is secured proximate the first end of each of said plurality of grooves that is operable to retain the multitude of ball bearings within said plurality of grooves. The ball bearings function to provide the only point of contact intermediate the reduced friction firearm component and an adjacent element.

15 Claims, 4 Drawing Sheets

REDUCED FRICTION FIREARM COMPONENTS

PRIORITY UNDER 35 U.S.C. SECTION 119(e) & 37 C.F.R. SECTION 1.78

This nonprovisional application claims priority based upon the following prior United States Provisional Patent Application entitled: Low Friction Bolt Carrier, Application No. 62/053,396 filed Sep. 22, 2014, in the name of Jason Adams and Carmelo Russo, which is hereby incorporated by reference for all purposes.

FIELD OF THE INVENTION

The present invention relates generally to firearms, more specifically but not by way of limitation, firearm components that slidably move during the operation of a firearm and further wherein the firearm components of the present invention are constructed so as to reduce the friction during the sliding movement thereof.

BACKGROUND

Automatic and semiautomatic rifles, including firearms based on the AR-15 service rifle and similar platforms, use impingement mechanisms to automatically reload. Capturing energy from fired ammunition to reload is typically accomplished using either direct impingement, i.e., porting pressurized gas from the barrel through a gas key to act directly on a bolt carrier, or using a piston system, in which gas drives a piston that impinges on an integral key on the bolt carrier. Both of these systems cause a piston-like action of the bolt carrier in the rifle's upper receiver, and in either case, repeated travel of the bolt carrier within the upper receiver coordinates cycling of the action which is inclusive of unlocking the bolt, ejecting the spent cartridge, chambering a new round, and so forth.

Ensuring a continuous and reliable automatic reloading operation during rapid firing over time requires that the bolt carrier travel smoothly in the upper receiver. Bolt carriers and upper receivers presently known in the art rely principally on precision milling or machining to produce a fit that adequately constrains the bolt carrier while providing adequate freedom of the back-and-forth movement. Despite a substantially complimentary fit, both the bolt carrier and upper receiver eventually suffer damage caused by sliding contact over prolonged periods of repeated firing. Heat buildup caused by friction is also a concern.

Direct impingement mechanisms are increasing disfavored due to a tendency to cause gas fouling. Over time, as carbon-laden gasses travel through the bolt carrier, the risk of a malfunction increases. Because automatic and semiautomatic rifles are often built on a common platform customarily employing standardized interchangeable parts, and due to the increasing preference for piston driven systems, users frequently customize firearms with newly developed aftermarket alternative components. These modifications occasionally result in a slightly imprecise fit between the bolt carrier and upper receiver, compounding existing friction-related problems and accelerating damage to the reloading mechanism.

Other components within firearms that perform repeated sliding movement and rely on precise machining include but are not limited to shotgun shell followers. As is known in the art, shotgun shell followers are operably coupled to a spring in the magazine tube of a shotgun and are operable to slidably move within the magazine tube and engage the shotgun shell adjacent thereto during the loading and firing process. The movement of the shotgun shell follower impacts performance of the firearm during the loading and firing process.

Due to the problems in the art, there is a need for improved firearm components such as but not limited to a bolt carrier and shotgun shell follower that avoids excessive friction from sliding movement during use of the firearm. There is also a need for a bolt carrier and shotgun shell follower capable of assembly as part of customizing or retrofitting a firearm. Additionally, it is desired for a bolt carrier and shotgun shell follower that are formed from a single piece of material, making it simple and inexpensive to mass produce.

SUMMARY OF THE INVENTION

It is the object of the present invention to provide firearm components that exhibit significantly reduced friction between themselves and adjacent firearm elements during the slidable movement thereof.

Another object of the present invention is to provide firearm components such as but not limited to bolt carriers and shotgun shell followers that include at least two diametrically opposed channels on the cylindrical bodies thereof.

A further object of the present invention is to provide firearm components that exhibit reduced friction between themselves and adjacent firearm elements wherein a plurality of ball bearings are releasably secured in the at least two diametrically opposed channels.

An additional object of the present invention is to provide firearm components such as but not limited to bolt carriers and shotgun shell followers that include at least two diametrically opposed channels with ball bearings therein that further include a retainer proximate an end of each channel.

Yet a further object of the present invention is to provide firearm components that exhibit significantly reduced friction between themselves and adjacent elements thereto that can be incorporated into an assembly or retrofit package for a particular firearm.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
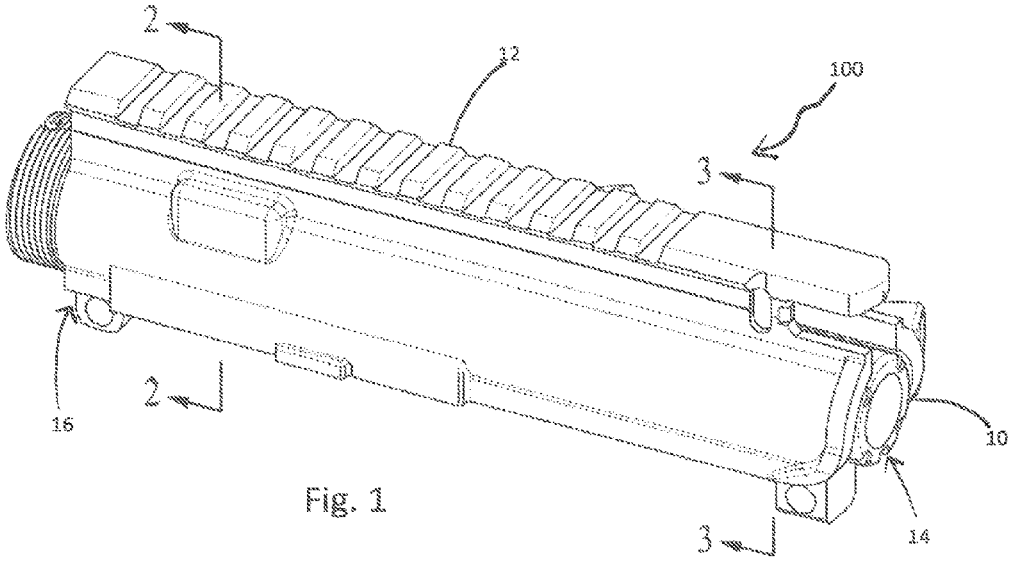
FIG. 1 is a perspective view of a low friction bolt carrier housed in an upper receiver of an automatic firearm.

Referring now to the drawings submitted herewith, wherein various elements depicted therein are not necessarily drawn to scale and wherein through the views and figures like elements are referenced with identical reference numerals, there is illustrated a reduced friction firearm component 100 constructed according to the principles of the present invention.

Referring to FIG. 1, the low friction bolt carrier embodiment 10 is housed in an upper receiver 12 of a firearm (firearm not shown). As is customary with existing bolt carriers, when the upper receiver 12 and low friction bolt carrier embodiment 10 are installed on the firearm, the front end 14 of the low friction bolt carrier embodiment 10 engages the chamber (not shown) of the barrel (not shown), while the rear end 16 of the low friction bolt carrier embodiment 10 engages the action spring (not shown) housed in the buttstock (not shown) of the firearm. During firing, the low friction bolt carrier embodiment 10 travels from the illustrated position 2,3 out of the upper receiver 12 until the action spring (not illustrated herein) acts on the rear end 16, pushing the low friction bolt carrier embodiment 10 back into the illustrated position.

Figure 2:
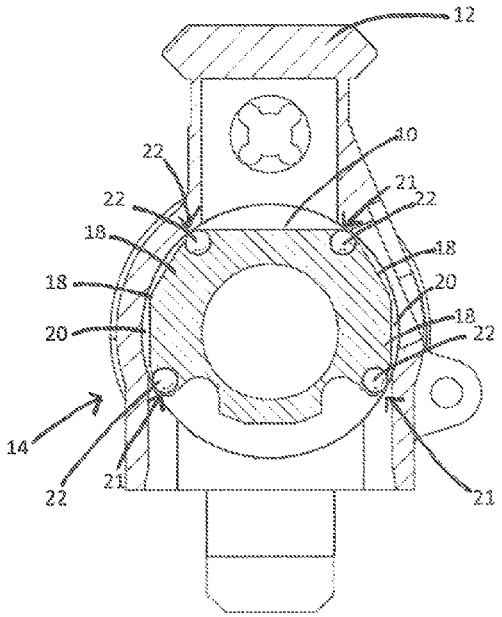
FIG. 2 is a front elevational view of the low friction bolt carrier housed in the upper receiver.

Referring to FIG. 2, a cutaway of the low friction bolt carrier embodiment 10 is shown near the front end 14 of the low friction bolt carrier embodiment 10. The low friction bolt carrier embodiment 10 includes flattened sides 18 that provide spaces 20 between the low friction bolt carrier embodiment 10 and the chamber upper receiver 12 for a frictionless fit. Where the flattened sides form intersecting corners 21, ball bearings 22 are held within and extend from the low friction bolt carrier embodiment 10 to contact the upper receiver 12. In this manner, the only contact between the low friction bolt carrier embodiment 10 on the upper receiver 12 is at the bearings 22. The bearings 22 are capable of spinning relative to both low friction bolt carrier embodiment 10 and upper receiver 12 providing greatly reduced friction as the low friction bolt carrier embodiment 10 moves relative to the upper receiver 12.

Figure 3:
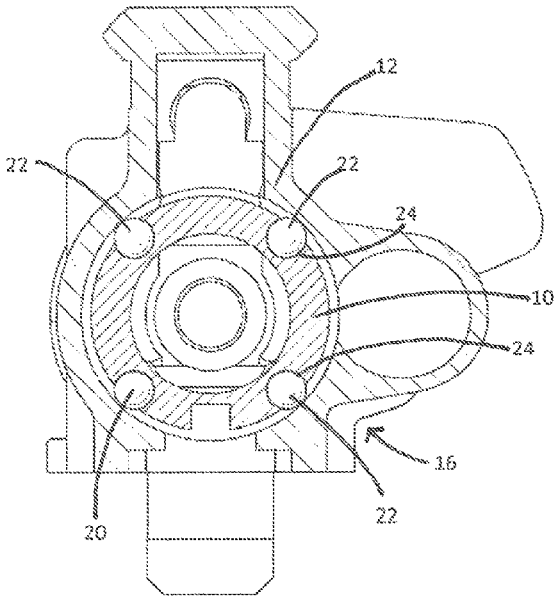
FIG. 3 is a rear view of the low friction bolt carrier housed in the upper receiver.

Referring to FIG. 3, a cutaway of the low friction bolt carrier embodiment 10 is shown near the rear end 16 of the low friction bolt carrier embodiment 10. Although the illustrated embodiment of the rear end 16 of the low friction bolt carrier embodiment 10 does not present flattened sides (ref. no 18, FIG. 2), alternative embodiments contemplate such an arrangement. The low friction bolt carrier embodiment 10 has a circumference reduced relative to the inner circumference of the upper receiver 12, such that when centered in the upper receiver 12, a frictionless space 20 is created between the low friction bolt carrier embodiment 10 and the upper receiver 12. Like the front end 14 (shown in FIG. 2) the rear end 16 of the low friction bolt carrier embodiment 10 includes bearings 22 housed in slots 24 and extend outward from the low friction bolt carrier embodiment 10. The bearings 22 contact the upper receiver 12 and provide the only contact surface between the upper receiver 12 and the low friction bolt carrier embodiment 10. As illustrated, the bearings 22 near the rear end 16 may be enlarged relative to the bearings 22 near the front end. Although four relatively evenly spaced bearings 22 are shown in the illustrated embodiment, other arrangements having more or fewer bearings 22 oriented with different spacing profiles of slots are contemplated. More specifically but not by way of limitation, it is contemplated within the scope of the present invention that the low frictions bolt carrier embodiment 10 could have as few as two slots 24. In this configuration the two slots 24 would be configured so as to be diametrically opposed to each other on the cylindrical low friction bolt carrier embodiment 10. Those skilled in the art will recognize that the low friction bolt carrier 10 could have more than two slots wherein the slots 24 could be arranged in various orientations around the low friction bolt carrier embodiment 10.

Figure 4:
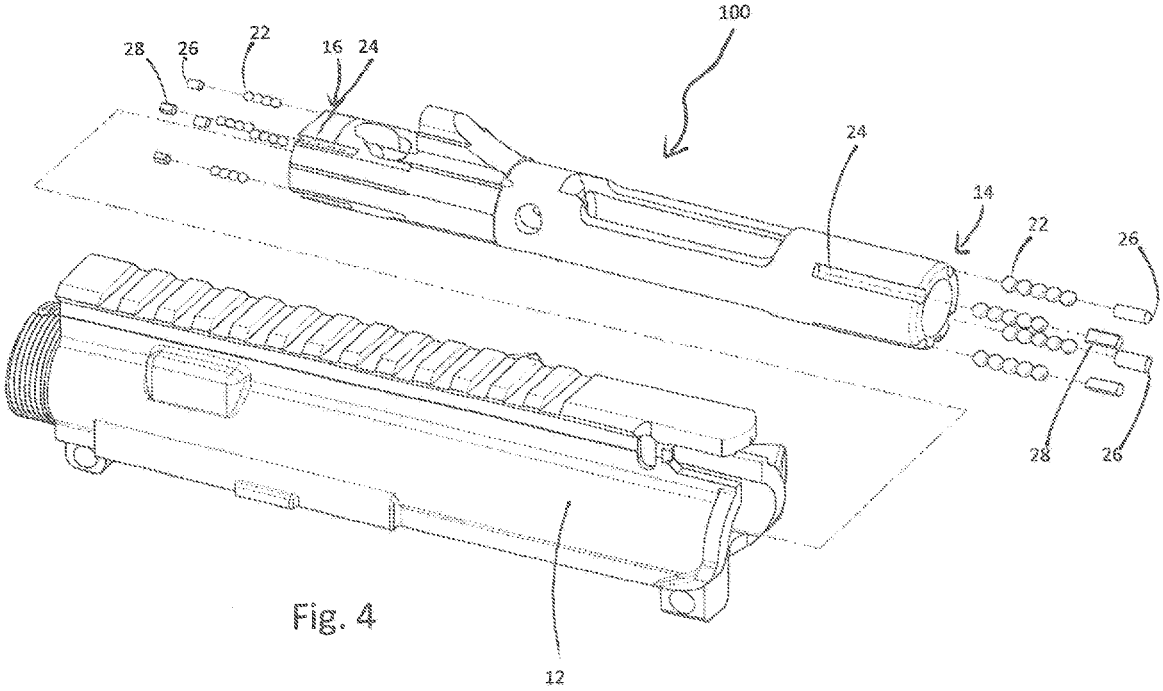
FIG. 4 is an exploded perspective view of the low friction bolt carrier and the upper receiver.

Referring to FIG. 4, an exploded view of the low friction bolt carrier embodiment 10 shows a series of slots 24 in which the bearings 22 are housed. Preferably the slots 24 are shallow enough to cause the bearings 22 to extend from the low friction bolt carrier embodiment 10, but sufficiently deep to retain the bearings 22 therein. To prevent the bearings 22 from exiting the slots 24, a plug 26 is inserted into each slot 24, preferably under a pressure fit. To prevent the plugs 26 from contacting the upper receiver 12, the plugs 26 preferably include a flat face 28 oriented toward an outer surface of the low friction bolt carrier embodiment 10. Due to the bearings 22 being positioned substantially adjacent the front end 14 and the rear end 16 of the low friction bolt carrier embodiment 10, the low friction bolt carrier embodiment 10 is both centered when installed in the upper receiver 12, and contacts the upper receiver 12 only at the bearings 22. While a plug 26 having a flat face 28 has been illustrated and described herein as a technique of releasably securing the bearings 22 within slots 24, it is contemplated within the scope of the present invention that the bearings 22 could be releasably secured within the slots 24 utilizing various different fasteners and/or techniques such as but not limited to a pin or stake.

Figure 5:
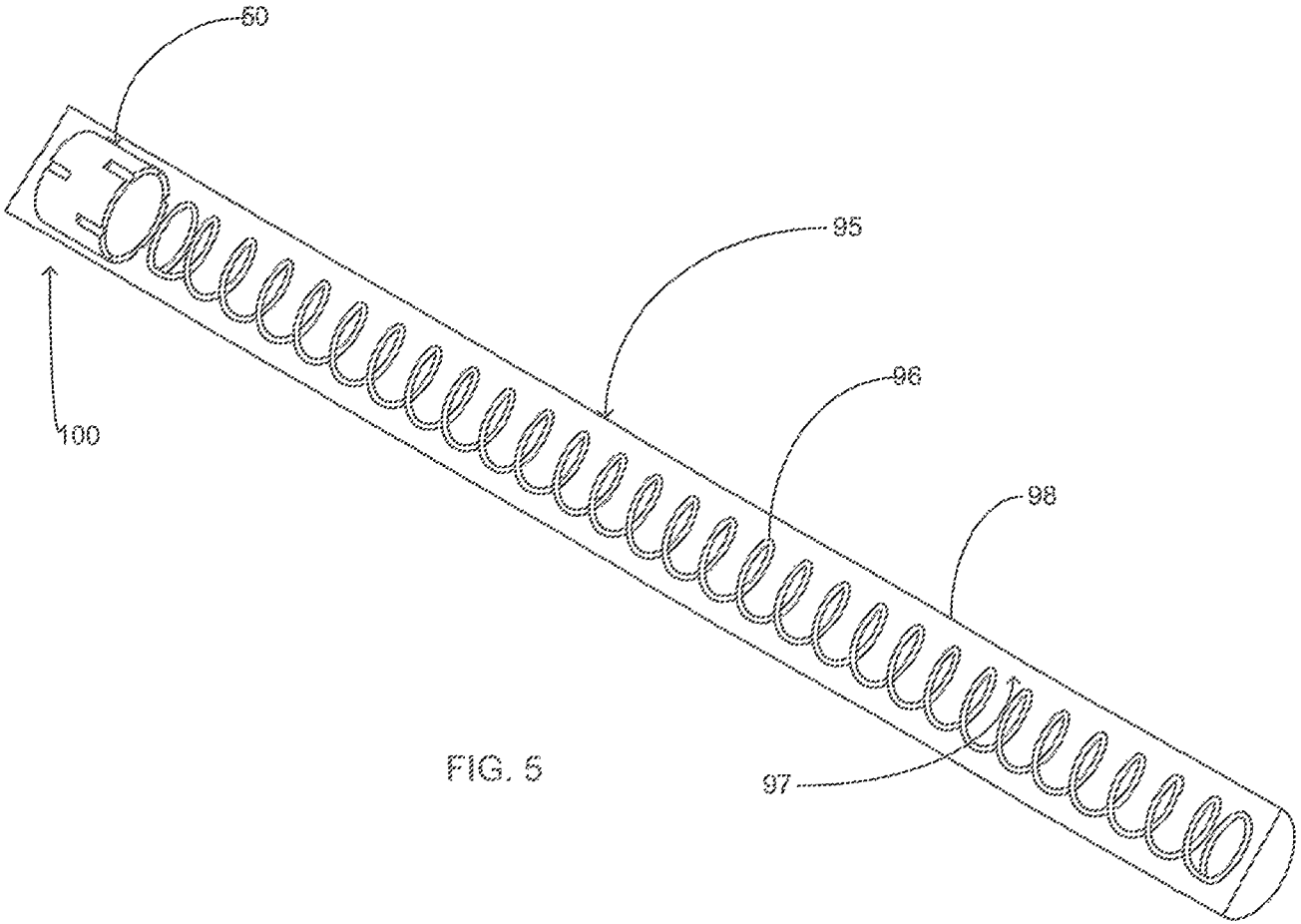
FIG. 5 is a cross-sectional diagrammatic view of a shotgun shell embodiment of the present invention disposed within a shotgun magazine tube.
Figure 6:
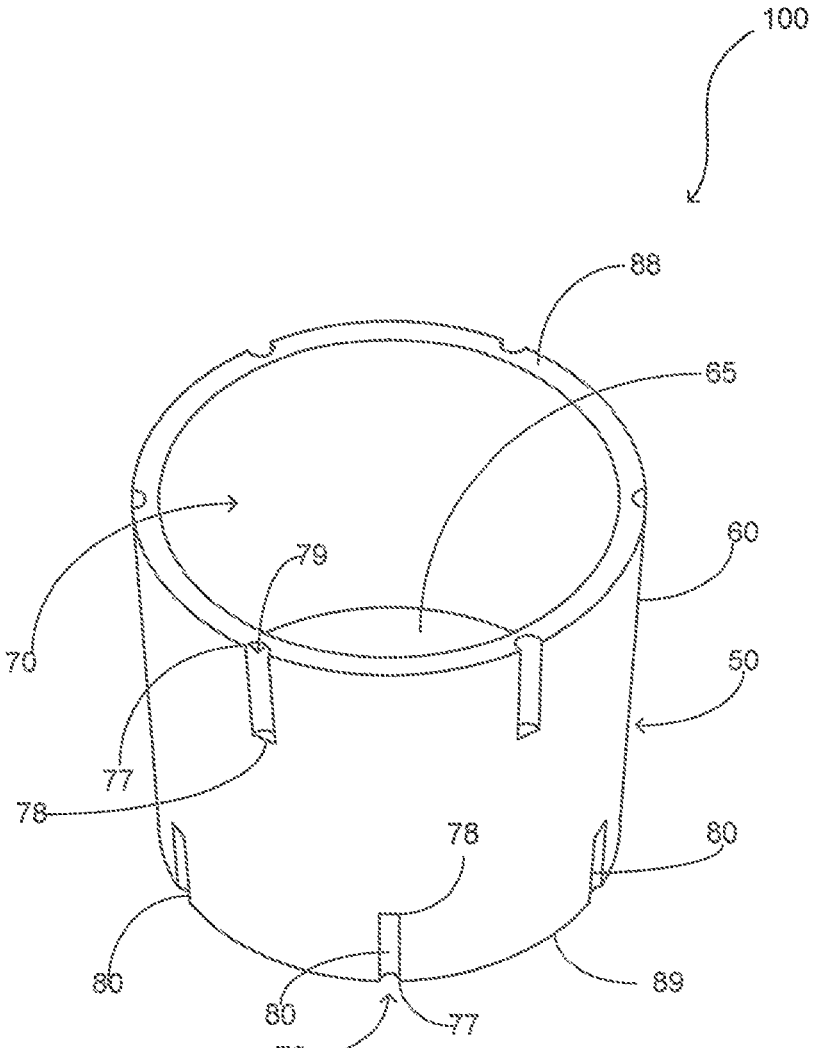
FIG. 6 is a perspective view a shotgun shell embodiment of the present invention.

Referring in particular to FIGS. 5 and 6 herein, there is illustrated a shotgun shell follower embodiment 50 of the present invention. The shotgun shell follower embodiment 50 includes wall 60 that is integrally formed with bottom 65 forming interior volume 70. The shotgun shell follower embodiment 50 is operable to be movably disposed within a conventional magazine tube 95 that is typically mounted underneath the barrel of a shotgun (not illustrated herein). The magazine tube 95 consists of wall 98 having inner surface 97. The wall 60 of the shotgun shell follower embodiment 50 is precisely milled such that the external diameter thereof is slightly less than the internal diameter of the magazine tube 95. A spring 96 is present and is operable to facilitate the movement of the shotgun shell follower embodiment 50 within the magazine tube 95.

The shotgun shell follower embodiment 50 is manufactured from a suitable durable material such as but not limited to metal. Wall 60 is integrally formed with bottom 65 utilizing suitable durable techniques. The wall 60 is cylindrical in shape so as to mateably engage with the magazine tube 95. Formed on the exterior surface 61 of the wall 60 are slots 24. The slots 24 are formed in a similar manner as the slots 24 on the low friction bolt carrier embodiment 10. The slots 24 have a first end 77 and second end 78 with end 77 having opening 79 and being proximate the upper edge 88 or lower edge 89. The slots 24 are circumferentially disposed on wall 60. The illustrated configuration of the slots 24 provides desired distribution of contact between the bearings 22 and the inner surface 97 of the magazine tube. Bearings 22 are mounted within slots 24 of the shotgun shell follower embodiment 50 in the same manner as the low friction bolt carrier embodiment 10. The bearings 22 are rotatable within slots 24 and are mounted such that the surface of the bearings 22 extends outward from the wall 60 and provides the only point of contact with inner surface 97. Advantages to this configuration provide a shotgun shell follower embodiment 50 that has improved balance within the magazine tube 95 and creates less friction therewith. While a plurality of slots 24 are illustrated herein, it is contemplated within the scope of the present invention that the slots 24 could be formed in the wall 60 with various spacing profiles. It is further contemplated within the scope of the present invention that the shotgun shell follower embodiment 50 could have as few as two slots 24 diametrically opposite on wall 60 provided a keeper or other similar device restricted the movement of the shotgun shell follower embodiment 50 specifically reducing any lateral movement within the magazine tube 95. While not illustrated on the shotgun shell follower embodiment 50, plugs 26 are utilized to secure bearings 22 within slots 24 of the shotgun shell follower embodiment 50 in the same manner as the low friction bolt carrier embodiment 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A reduced friction firearm component mounted within a firearm comprising:

a body, said body being cylindrical in shape, said body having an exterior surface, said body having a first end and a second end, said body being movably mounted within a firearm;

at least two slots, said at least two slots being formed in the exterior surface of said body, said at least two slots being diametrically opposite on said body, said at least two slots having a cavity, said at least two slots having a first end and a second end, said first end of said at least two slots extending to said first end of said body and having an opening at said first end configured to provide access to said cavity of said at least two slots;

a plurality of ball bearings, said plurality of ball bearing being secured within said cavity of said at least two slots, said plurality of ball bearings being rotatably mounted within said at least two slots, said plurality of ball bearings being mounted within said cavity of said at least two slots wherein the ball bearings extend beyond the exterior surface of said body; and wherein the ball bearings function to provide the only point of contact intermediate the reduced friction firearm component and an adjacent element of the firearm.

2. The reduced friction firearm component as recited in claim 1, and further including a fastener, said fastener being secured into said opening of said at least two slots at the first end said at least two slots, said fastener being operable to secure said plurality of ball bearings within said at least two slots.

3. The reduced friction firearm component as recited in claim 2, wherein the reduced friction firearm component is selected from a group of one of the following: a bolt carrier or a shotgun shell follower.

4. The reduced friction firearm component as recited in claim 3, wherein said fastener further includes a flattened surface, said flattened surface of said fastener operable to inhibit said fastener from extending beyond the exterior surface of said body.

5. The reduced friction firearm component as recited in claim 4, wherein said at least two slots have a first end and a second end, said first end of said at least two slots being proximate said first end of said body.

6. The reduced friction firearm component as recited in claim 5, wherein said at least two slots are formed within said exterior surface of said body such that said at least two slots have a length that is shorter than that of said body.

7. A reduced friction firearm component wherein said reduced friction firearm component is movably mounted within a firearm comprising:

a body, said body being cylindrical in shape, said body having an exterior surface, said body having a first end and a second end;

a plurality of grooves, said plurality of grooves being formed in said exterior surface of said body, said plurality of grooves having a first end and a second end, said first end of said plurality of grooves extending to said first end of said body and having an opening at said first end, said plurality of grooves being dispersed circumferentially around said body;

a multitude of ball bearings, said multitude of ball bearings being rotatably mounted within said plurality of grooves, said ball bearings being round in shape, said ball bearing being secured intermediate said first end and said second end of said plurality of grooves, said multitude of ball bearings mounted so as to extend beyond the exterior surface of said body;

a plurality of fasteners, said plurality of fasteners being secured within said openings of said plurality of grooves at said first end; and wherein the multitude of ball bearings function to provide the only point of contact intermediate the reduced friction firearm component and an adjacent element of the firearm.

8. The reduced friction firearm component as recited in claim 7, wherein said plurality of grooves are evenly dispersed around the circumference of said body.

9. The reduced friction firearm component as recited in claim 8, wherein the reduced friction firearm component is selected from a group of one of the following: a bolt carrier or a shotgun shell follower.

10. The reduced friction firearm component as recited in claim 7, wherein said plurality of fasteners further includes a flattened surface, said flattened surface of said plurality of fasteners operable to ensure said plurality of fasteners do not extend upward past said body of the reduced friction firearm component.

11. The reduced friction firearm component as recited in claim 10, wherein said multitude of ball bearings function to isolate contact between the reduced friction firearm component and an adjacent element of the firearm during a sliding motion of the reduced friction firearm component.

12. A reduced friction firearm component that is slidably mounted within a firearm comprising:

a body, said body being cylindrical in shape, said body having an exterior surface, said body having a first end and a second end, said body having a defined length intermediate said first end and said second end;

a first set of grooves, said first set of grooves being formed in said exterior surface of said body, said first set of grooves having a first end and a second end, said first set of grooves being dispersed circumferentially around said body, said first set of grooves being proximate said first end of said body, said first end of said first set of grooves extending to said first end of said body said first set of grooves having an opening proximate said first end;

a second set of grooves, said second set of grooves being formed in said exterior surface of said body, said second set of grooves having a first end and a second end, said second set of grooves being dispersed circumferentially around said body, said second set of grooves being proximate said second end of said body, said first end of said second set of grooves extending to said second end of said body, said second set of grooves having an opening proximate said first end;

a multitude of ball bearings, said multitude of ball bearings being rotatably mounted within first set of grooves and said second set of grooves, said ball bearings being round in shape, said multitude of ball bearings mounted so as to extend beyond the exterior surface of said body;

a plurality of fasteners, said plurality of fasteners being secured within said first set of grooves and said second set of grooves, said plurality of fasteners being semicircular in shape and secured within said openings of said first set of grooves and said second set of grooves so as to not extend beyond the exterior surface of said body;

wherein the multitude of ball bearings function to provide the only point of contact intermediate the reduced friction firearm component and an adjacent element of the firearm.

13. The reduced friction firearm component as recited in claim 12, wherein said first set of grooves extend only partially along the defined length of said body.

14. The reduced friction firearm component as recited in claim 13, wherein said second set of grooves extend only partially along the defined length of said body.

15. The reduced friction firearm component as recited in claim 14, wherein the reduced friction firearm component is selected from a group of one of the following: a bolt carrier or a shotgun shell follower.

* * * * *